US011825291B2

(12) United States Patent
Robinson et al.

(10) Patent No.: US 11,825,291 B2
(45) **Date of Patent: *Nov. 21, 2023**

(54) DISCRETE BINAURAL SPATIALIZATION OF SOUND SOURCES ON TWO AUDIO CHANNELS

(71) Applicant: Meta Platforms Technologies, LLC, Menlo Park, CA (US)

(72) Inventors: Philip Robinson, Seattle, WA (US); Sebastian Elliot Chafe, Seattle, WA (US)

(73) Assignee: Meta Platforms Technologies, LLC, Menlo Park, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/101,491

(22) Filed: Jan. 25, 2023

(65) Prior Publication Data

US 2023/0171560 A1 Jun. 1, 2023

Related U.S. Application Data

(63) Continuation of application No. 17/223,345, filed on Apr. 6, 2021, now Pat. No. 11,595,775.

(51) Int. Cl.
*H04S 7/00* (2006.01)
*H04R 5/02* (2006.01)
(Continued)

(52) U.S. Cl.
CPC ..... *H04S 7/304* (2013.01); *H04R 5/02* (2013.01); *H04R 5/033* (2013.01); *H04R 5/04* (2013.01);
(Continued)

(58) Field of Classification Search
None
See application file for complete search history.

(56) References Cited

U.S. PATENT DOCUMENTS 10,819,953 B1 10/2020 Lovitt et al.
10,880,649 B2 * 12/2020 Johnson ..... H04R 5/04
(Continued)

FOREIGN PATENT DOCUMENTS

CA 2943670 C * 2/2021 ..... G10L 19/008
GB 2579348 A * 6/2020 ..... G10L 19/008

OTHER PUBLICATIONS

International Search Report and Written Opinion for International Application No. PCT/US2022/023197, dated Jul. 22, 2022, 12 pages.
(Continued)

*Primary Examiner* — Qin Zhu
(74) *Attorney, Agent, or Firm* — Fenwick & West LLP

(57) ABSTRACT

Embodiments relate to binaural spatialization of more than two sound sources on two audio channels of an audio system. Sound signals each emitted from a corresponding sound source are collected, and a respective virtual position within an angular range of a sound scene is assigned to each sound source. Multi-source audio signals are generated by panning each sound signal according to the respective virtual position. A first multi-source audio signal is spatialized to a first direction to generate a first left signal and a first right signal. A second multi-source audio signal is spatialized to a second direction to generate a second left signal and a second right signal. A binaural signal is generated using the first left signal, the second left signal, the first right signal, and the second right signal. The binaural signal is such that each sound source appears to originate from its respective virtual position.

20 Claims, 7 Drawing Sheets

(51) Int. Cl.

| | |
|---|---|
| ***H04R 5/033*** | (2006.01) |
| ***H04R 5/04*** | (2006.01) |
| ***H04S 1/00*** | (2006.01) |
| ***H04R 1/40*** | (2006.01) |
| ***H04R 3/00*** | (2006.01) |

(52) U.S. Cl.
CPC ..... *H04S 1/007* (2013.01); *H04S 2400/11* (2013.01); *H04S 2420/01* (2013.01)

(56) References Cited

U.S. PATENT DOCUMENTS

| | | | | |
|---|---|---|---|---|
| 2003/0174845 | A1* | 9/2003 | Hagiwara | H04S 3/00 381/17 |
| 2006/0072764 | A1 | 4/2006 | Mertens et al. | |
| 2008/0298610 | A1 | 12/2008 | Virolainen et al. | |
| 2015/0055770 | A1 | 2/2015 | Spittle et al. | |
| 2015/0078581 | A1 | 3/2015 | Etter et al. | |
| 2015/0244869 | A1 | 8/2015 | Cartwright et al. | |
| 2016/0112819 | A1 | 4/2016 | Mehnert et al. | |
| 2017/0078819 | A1 | 3/2017 | Habets et al. | |
| 2017/0094438 | A1* | 3/2017 | Chon | H04S 5/005 |
| 2019/0215632 | A1 | 7/2019 | Chung et al. | |
| 2019/0387352 | A1 | 12/2019 | Jot et al. | |
| 2021/0204085 | A1 | 7/2021 | Claar | |

OTHER PUBLICATIONS

Pulkki V., "Virtual Sound Source Positioning Using Vector Base Amplitude Planning," A journal of the Audio Engineering Society, Jun. 1, 1997, vol. 45, No. 6, pp. 456-466.

Shukla R., et al., "Real-Time Binaural Rendering with Virtual Vector Base Amplitude Panning," 2019 AES International Conference on Immersive and Interactive Audio, Mar. 27-29, 2019, 10 pages.

* cited by examiner

DISCRETE BINAURAL SPATIALIZATION OF SOUND SOURCES ON TWO AUDIO CHANNELS

CROSS REFERENCE TO RELATED APPLICATIONS

This application is a continuation of co-pending U.S. application Ser. No. 17/223,345, filed Apr. 6, 2021, which is incorporated by reference in its entirety.

FIELD OF THE INVENTION

The present disclosure relates generally to presentation of audio at a headset, and specifically relates to a discrete binaural spatialization of sound sources on two audio channels of an audio system coupled to the headset.

BACKGROUND

The traditional approach to spatialize multiple virtual sound sources is to provide one channel of an un-spatialized audio signal through a filter (e.g., head-related transfer function) that produces one audio channel signal for each ear while incorporating spatial cues to produce a perception of each virtual sound source in a particular position in a sound scene (i.e., physical space) around a listener. For a typical artificial reality headset scenario with wireless connectivity (e.g., Bluetooth connection with a smart phone or a console), audio signals are transmitted to the headset via only two audio channels, which limits a sound scene to two virtual sound sources.

SUMMARY

Embodiments of the present disclosure support a method, computer readable medium, and apparatus for a discrete binaural spatialization of more than two sound sources on two audio channels of an audio system for presentation of audio content to a user of the audio system. At least a portion of the audio system is integrated into a headset worn by the user. A plurality of sound signals each emitted from a corresponding sound source of a plurality of sound sources are collected at the audio system. A respective virtual position within an angular range of a sound scene is assigned to each sound source. A first multi-source audio signal and a second multi-source audio signal are generated by panning each sound signal according to the respective virtual position. The first multi-source audio signal is spatialized to a first direction to generate a first left signal and a first right signal. The second multi-source audio signal is spatialized to a second direction to generate a second left signal and a second right signal. A binaural signal is generated using the first left signal, the second left signal, the first right signal, and the second right signal. The binaural signal generated by the audio system is such that each sound source appears to the user to originate from the respective virtual position.

Figure 1A:
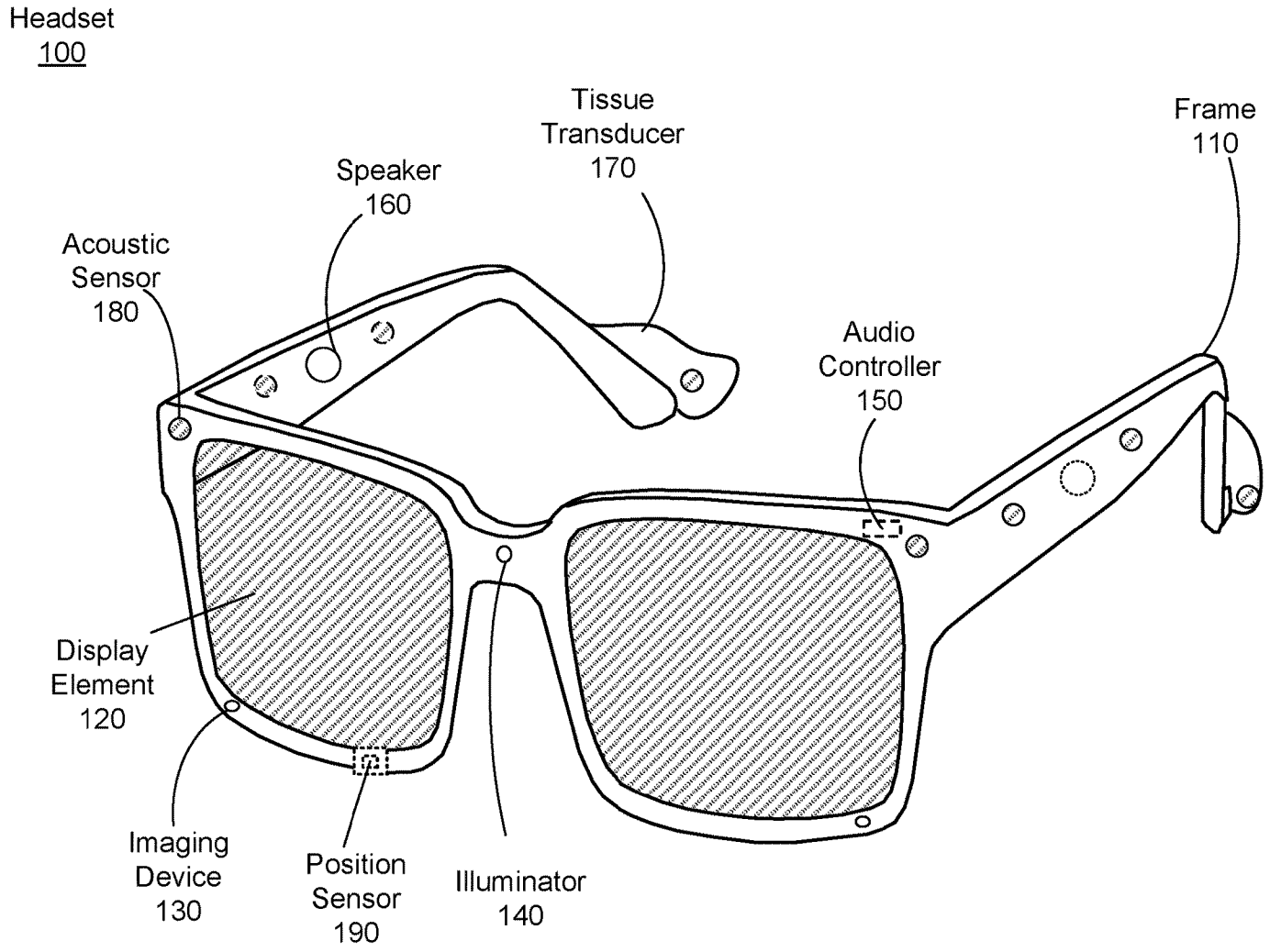
FIG. 1A is a perspective view of a headset implemented as an eyewear device, in accordance with one or more embodiments.

The figures depict various embodiments for purposes of illustration only. One skilled in the art will readily recognize from the following discussion that alternative embodiments of the structures and methods illustrated herein may be employed without departing from the principles described herein.

DETAILED DESCRIPTION

Embodiments of the present disclosure relate to a discrete binaural spatialization of more than two sound sources (e.g., virtual sound sources) on a pair of audio channels of an audio system. The present disclosure describes a method and system for generating a binaural signal that originates from more than two sound sources such that the binaural signal appears to a user of the audio system to originate from respective virtual positions of the sound sources within a sound scene around a headset (e.g., artificial reality glasses) worn by the user. A virtual position of a sound source is a location within the sound scene from which a sound from the sound source is perceived to originate. In some embodiments, the audio system is fully integrated into the headset. In some other embodiments, the audio system is distributed among multiple devices, such as between a computing device (e.g., smart phone or a console) and the headset interfaced with the computing device (e.g., via wireless connection). Due to communication bandwidth requirements, the audio system utilizes only two audio channels for communication, such as a pair audio channels at the headset (if the audio system is fully integrated into the headset), or a pair of audio channels between the computing device and the headset (if the audio system is distributed between the computing device and the headset). Therefore, the audio system presented herein utilizes its two audio channels for performing a discrete binaural spatialization of more than two sound sources. The audio system presented herein applies localization summing in combination with phantom source perceptual phenomena for placement of more than two sound sources in a sound scene while utilizing only two audio channels.

The audio system presented herein collects a plurality of sound signals each emitted from a corresponding sound source of a plurality of sound sources, and a respective virtual position within an angular range of a sound scene is assigned to each sound source. The audio system generates a first multi-source audio signal associated with a first direction of the sound scene and a second multi-source audio signal associated with a first direction of the sound scene by panning each sound signal according to its respective virtual position. The audio system spatializes the first multi-source audio signal to the first direction to generate a first left signal and a first right signal. Similarly, the audio system spatializes the second multi-source audio signal to the second direction to generate a second left signal and a second right signal. The audio system generates a binaural signal for presentation to the user by combining the first left signal, the second left signal, the first right signal, and the second right signal. The generated binaural signal for presentation to the user is such that each sound source appears to the user to originate from its respective virtual position.

The audio system presented herein applies a scheme that facilitates placing of more than two virtual sound sources within a sound scene around a user of a headset, while exploiting existing bandwidth requirements for communicating audio signals between the audio system and the headset. This is achieved herein by a discrete spatialization of independent sound sources, which generates a pair of spatialized multi-source audio signals that are compatible with a pair of audio channels of the audio system. The pair of spatialized multi-source audio signals are fed into the two audio channels for presentation to the user.

Embodiments of the invention may include or be implemented in conjunction with an artificial reality system. Artificial reality is a form of reality that has been adjusted in some manner before presentation to a user, which may include, e.g., a virtual reality (VR), an augmented reality (AR), a mixed reality (MR), a hybrid reality, or some combination and/or derivatives thereof. Artificial reality content may include completely generated content or generated content combined with captured (e.g., real-world) content. The artificial reality content may include video, audio, haptic feedback, or some combination thereof, any of which may be presented in a single channel or in multiple channels (such as stereo video that produces a three-dimensional effect to the viewer). Additionally, in some embodiments, artificial reality may also be associated with applications, products, accessories, services, or some combination thereof, that are used to create content in an artificial reality and/or are otherwise used in an artificial reality. The artificial reality system that provides the artificial reality content may be implemented on various platforms, including a wearable device (e.g., headset) connected to a host computer system, a standalone wearable device (e.g., headset), a mobile device or computing system, or any other hardware platform capable of providing artificial reality content to one or more viewers.

FIG. 1A is a perspective view of a headset 100 implemented as an eyewear device, in accordance with one or more embodiments. In some embodiments, the eyewear device is a near eye display (NED). In general, the headset 100 may be worn on the face of a user such that content (e.g., media content) is presented using a display assembly and/or an audio system. However, the headset 100 may also be used such that media content is presented to a user in a different manner. Examples of media content presented by the headset 100 include one or more images, video, audio, or some combination thereof. The headset 100 includes a frame, and may include, among other components, a display assembly including one or more display elements 120, a depth camera assembly (DCA), an audio system, and a position sensor 190. While FIG. 1A illustrates the components of the headset 100 in example locations on the headset 100, the components may be located elsewhere on the headset 100, on a peripheral device paired with the headset 100, or some combination thereof. Similarly, there may be more or fewer components on the headset 100 than what is shown in FIG. 1A.

The frame 110 holds the other components of the headset 100. The frame 110 includes a front part that holds the one or more display elements 120 and end pieces (e.g., temples) to attach to a head of the user. The front part of the frame 110 bridges the top of a nose of the user. The length of the end pieces may be adjustable (e.g., adjustable temple length) to fit different users. The end pieces may also include a portion that curls behind the ear of the user (e.g., temple tip, ear piece).

The one or more display elements 120 provide light to a user wearing the headset 100. As illustrated the headset includes a display element 120 for each eye of a user. In some embodiments, a display element 120 generates image light that is provided to an eye box of the headset 100. The eye box is a location in space that an eye of user occupies while wearing the headset 100. For example, a display element 120 may be a waveguide display. A waveguide display includes a light source (e.g., a two-dimensional source, one or more line sources, one or more point sources, etc.) and one or more waveguides. Light from the light source is in-coupled into the one or more waveguides which outputs the light in a manner such that there is pupil replication in an eye box of the headset 100. In-coupling and/or outcoupling of light from the one or more waveguides may be done using one or more diffraction gratings. In some embodiments, the waveguide display includes a scanning element (e.g., waveguide, mirror, etc.) that scans light from the light source as it is in-coupled into the one or more waveguides. Note that in some embodiments, one or both of the display elements 120 are opaque and do not transmit light from a local area around the headset 100. The local area is the area surrounding the headset 100. For example, the local area may be a room that a user wearing the headset 100 is inside, or the user wearing the headset 100 may be outside and the local area is an outside area. In this context, the headset 100 generates VR content. Alternatively, in some embodiments, one or both of the display elements 120 are at least partially transparent, such that light from the local area may be combined with light from the one or more display elements to produce AR and/or MR content.

In some embodiments, a display element 120 does not generate image light, and instead is a lens that transmits light from the local area to the eye box. For example, one or both of the display elements 120 may be a lens without correction (non-prescription) or a prescription lens (e.g., single vision, bifocal and trifocal, or progressive) to help correct for defects in a user's eyesight. In some embodiments, the display element 120 may be polarized and/or tinted to protect the user's eyes from the sun.

In some embodiments, the display element 120 may include an additional optics block (not shown). The optics block may include one or more optical elements (e.g., lens, Fresnel lens, etc.) that direct light from the display element 120 to the eye box. The optics block may, e.g., correct for aberrations in some or all of the image content, magnify some or all of the image, or some combination thereof.

The DCA determines depth information for a portion of a local area surrounding the headset 100. The DCA includes one or more imaging devices 130 and a DCA controller (not shown in FIG. 1A), and may also include an illuminator 140. In some embodiments, the illuminator 140 illuminates a portion of the local area with light. The light may be, e.g., structured light (e.g., dot pattern, bars, etc.) in the infrared (IR), IR flash for time-of-flight, etc. In some embodiments, the one or more imaging devices 130 capture images of the portion of the local area that include the light from the illuminator 140. As illustrated, FIG. 1A shows a single illuminator 140 and two imaging devices 130. In alternate embodiments, there is no illuminator 140 and at least two imaging devices 130.

The DCA controller computes depth information for the portion of the local area using the captured images and one or more depth determination techniques. The depth determination technique may be, e.g., direct time-of-flight (ToF) depth sensing, indirect ToF depth sensing, structured light, passive stereo analysis, active stereo analysis (uses texture added to the scene by light from the illuminator 140), some other technique to determine depth of a scene, or some combination thereof.

The audio system provides audio content. The audio system includes a transducer array, a sensor array, and an audio controller 150. However, in other embodiments, the audio system may include different and/or additional components. Similarly, in some cases, functionality described with reference to the components of the audio system can be distributed among the components in a different manner than is described here. For example, some or all of the functions of the audio controller 150 may be performed by a remote server.

The transducer array presents sound to user. The transducer array includes a plurality of transducers. A transducer may be a speaker 160 or a tissue transducer 170 (e.g., a bone conduction transducer or a cartilage conduction transducer). Although the speakers 160 are shown exterior to the frame 110, the speakers 160 may be enclosed in the frame 110. The tissue transducer 170 couples to the head of the user and directly vibrates tissue (e.g., bone or cartilage) of the user to generate sound. In accordance with embodiments of the present disclosure, the transducer array comprises two transducers (e.g., two speakers 160, two tissue transducers 170, or one speaker 160 and one tissue transducer 170), i.e., one transducer for each ear. The locations of transducers may be different from what is shown in FIG. 1A.

The sensor array detects sounds within the local area of the headset 100. The sensor array includes a plurality of acoustic sensors 180. An acoustic sensor 180 captures sounds emitted from one or more sound sources in the local area (e.g., a room). Each acoustic sensor is configured to detect sound and convert the detected sound into an electronic format (analog or digital). The acoustic sensors 180 may be acoustic wave sensors, microphones, sound transducers, or similar sensors that are suitable for detecting sounds.

In some embodiments, one or more acoustic sensors 180 may be placed in an ear canal of each ear (e.g., acting as binaural microphones). In some embodiments, the acoustic sensors 180 may be placed on an exterior surface of the headset 100, placed on an interior surface of the headset 100, separate from the headset 100 (e.g., part of some other device), or some combination thereof. The number and/or locations of acoustic sensors 180 may be different from what is shown in FIG. 1A. For example, the number of acoustic detection locations may be increased to increase the amount of audio information collected and the sensitivity and/or accuracy of the information. The acoustic detection locations may be oriented such that the microphone is able to detect sounds in a wide range of directions surrounding the user wearing the headset 100.

The audio controller 150 processes information from the sensor array that describes sounds detected by the sensor array. The audio controller 150 may comprise a processor and a non-transitory computer-readable storage medium. The audio controller 150 may be configured to generate direction of arrival (DOA) estimates, generate acoustic transfer functions (e.g., array transfer functions and/or head-related transfer functions), track the location of sound sources, form beams in the direction of sound sources, classify sound sources, generate sound filters for the speakers 160, or some combination thereof.

In accordance with embodiments of the present disclosure, the audio controller 150 performs a discrete binaural spatialization of more than two sound sources (e.g., virtual sound sources) on a pair of audio channels of the audio system. The audio controller 150 may generate a binaural signal that originates from more than two sound sources such that the binaural signal appears to the user of the audio system to originate from respective virtual positions of sound sources within a sound scene around the headset 100. The generated binaural signal may be presented to the user, e.g., via the speakers 160 and/or the tissue transducers 170.

The audio controller 150 may first collect (e.g., at the non-transitory computer-readable storage medium) a plurality of sound signals each emitted from a corresponding sound source. The audio controller 150 may assign a respective virtual position within an angular range of the sound scene to each sound source. The audio controller 150 may perform a perceptual localization summing of sound signals emitted from more than two sound sources by splitting and panning energy of each sound signal according to the respective virtual position of each sound source to generate multi-source audio signals. A specific angular direction (e.g., that matches a boundary of the angular range) can be assigned to each audio channel of the audio system. Each multi-source sound signal may be fed into a respective audio channel of the audio system for spatialization onto the specific angular direction (e.g., by applying corresponding sound filters by the audio controller 150) and generation of the binaural signal that appears to the user to originate from a respective virtual position of each sound source.

In this manner, the audio system is able to add additional sound sources (e.g., talkers) between a pair sound sources assigned to specific angular directions of the angular range (e.g., the angular directions matching boundaries of the angular range). In an exemplary case, the audio system records (e.g., by the audio controller 150) a spatial group call with a total of three different callers (i.e., sound sources or talkers). The angular range of the sound scene (e.g., angular range of 120°) can be evenly divided among the three different sound sources, and a respective virtual position having a corresponding angular direction is assigned to each sound source. All sound sources may be at the same elevation within the sound scene. In general, the sound sources could be spread between any two points within the sound scene.

In some embodiments, two of the sound sources can be assigned to virtual positions that match boundaries of the angular range, e.g., to virtual positions of the sound scene having angular directions of +60° and −60°. A third sound source can be assigned to a center position between the other two sound sources, e.g., to a virtual position of the sound scene having an angular direction of 0°. The audio controller 150 can evenly split (i.e., pan) an energy of a sound signal from the third sound source between the two audio channels, and the sound signal from the third sound source would appear as originating from the center position of the sound scene between the other two sound sources. This is because two localization cues (e.g., corresponding to angular directions of +60° and −60°) are perceptually summed to the virtual position corresponding to the angular direction of 0°. Virtual positions of the other two sound sources are not affected as sound signals of the other two sound sources each has a spatial cue associated with a single virtual position (e.g., virtual positions having an angular directions of +60° or −60°). Although mixed together with sound signals from the other two sound sources, the sound signal originating from the third sound source is coherent in both audio channels of the audio system, and only those coherent portions of the sound signal from the third sound source are subject to the perceptual summing localization.

In some embodiments, the audio system is fully integrated into the headset 100. In some other embodiments, the audio system is distributed among multiple devices, such as between a computing device (e.g., smart phone or a console) and the headset 100. The computing device may be interfaced (e.g., via a wired or wireless connection) with the headset 100. In such cases, some of the processing steps presented herein may be performed at a portion of the audio system integrated into the computing device. For example, one or more functions of the audio controller 150 may be implemented at the computing device. More details about the structure and operations of the audio system are described in connection with FIG. 2, FIGS. 3A-3B, FIG. 4 and FIG. 5.

The position sensor 190 generates one or more measurement signals in response to motion of the headset 100. The position sensor 190 may be located on a portion of the frame 110 of the headset 100. The position sensor 190 may include an inertial measurement unit (IMU). Examples of position sensor 190 include: one or more accelerometers, one or more gyroscopes, one or more magnetometers, another suitable type of sensor that detects motion, a type of sensor used for error correction of the IMU, or some combination thereof. The position sensor 190 may be located external to the IMU, internal to the IMU, or some combination thereof.

The audio system can use positional information describing the headset 100 (e.g., from the position sensor 190) to update virtual positions of sound sources so that the sound sources are positionally locked relative to the headset 100. In this case, when the user wearing the headset 100 turns their head, virtual positions of the virtual sources move with the head. Alternatively, virtual positions of the virtual sources are not locked relative to an orientation of the headset 100. In this case, when the user wearing the headset 100 turns their head, apparent virtual positions of the sound sources would not change.

In some embodiments, the headset 100 may provide for simultaneous localization and mapping (SLAM) for a position of the headset 100 and updating of a model of the local area. For example, the headset 100 may include a passive camera assembly (PCA) that generates color image data. The PCA may include one or more RGB cameras that capture images of some or all of the local area. In some embodiments, some or all of the imaging devices 130 of the DCA may also function as the PCA. The images captured by the PCA and the depth information determined by the DCA may be used to determine parameters of the local area, generate a model of the local area, update a model of the local area, or some combination thereof. Furthermore, the position sensor 190 tracks the position (e.g., location and pose) of the headset 100 within the room. Additional details regarding the components of the headset 100 are discussed below in connection with FIG. 2, FIGS. 3A-3B, and FIG. 5.

Figure 1B:
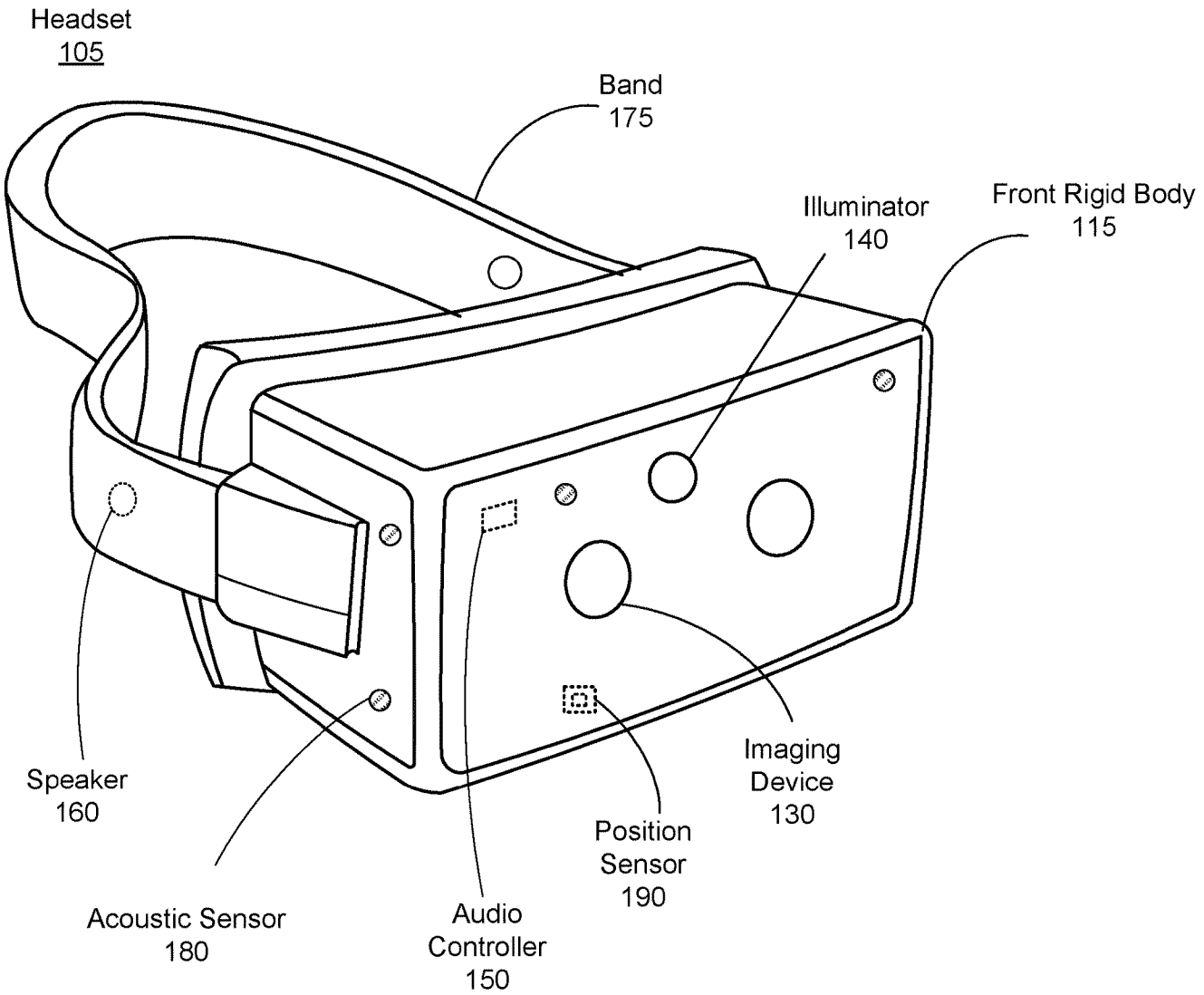
FIG. 1B is a perspective view of a headset implemented as a head-mounted display, in accordance with one or more embodiments.

FIG. 1B is a perspective view of a headset 105 implemented as a HMD, in accordance with one or more embodiments. In embodiments that describe an AR system and/or a MR system, portions of a front side of the HMD are at least partially transparent in the visible band (~380 nm to 750 nm), and portions of the HMD that are between the front side of the HMD and an eye of the user are at least partially transparent (e.g., a partially transparent electronic display). The HMD includes a front rigid body 115 and a band 175. The headset 105 includes many of the same components described above with reference to FIG. 1A, but modified to integrate with the HMD form factor. For example, the HMD includes a display assembly, a DCA, an audio system, and a position sensor 190. FIG. 1B shows the illuminator 140, a plurality of the speakers 160, a plurality of the imaging devices 130, a plurality of acoustic sensors 180, and the position sensor 190. The speakers 160 may be located in various locations, such as coupled to the band 175 (as shown), coupled to the front rigid body 115, or may be configured to be inserted within the ear canal of a user.

Figure 2:
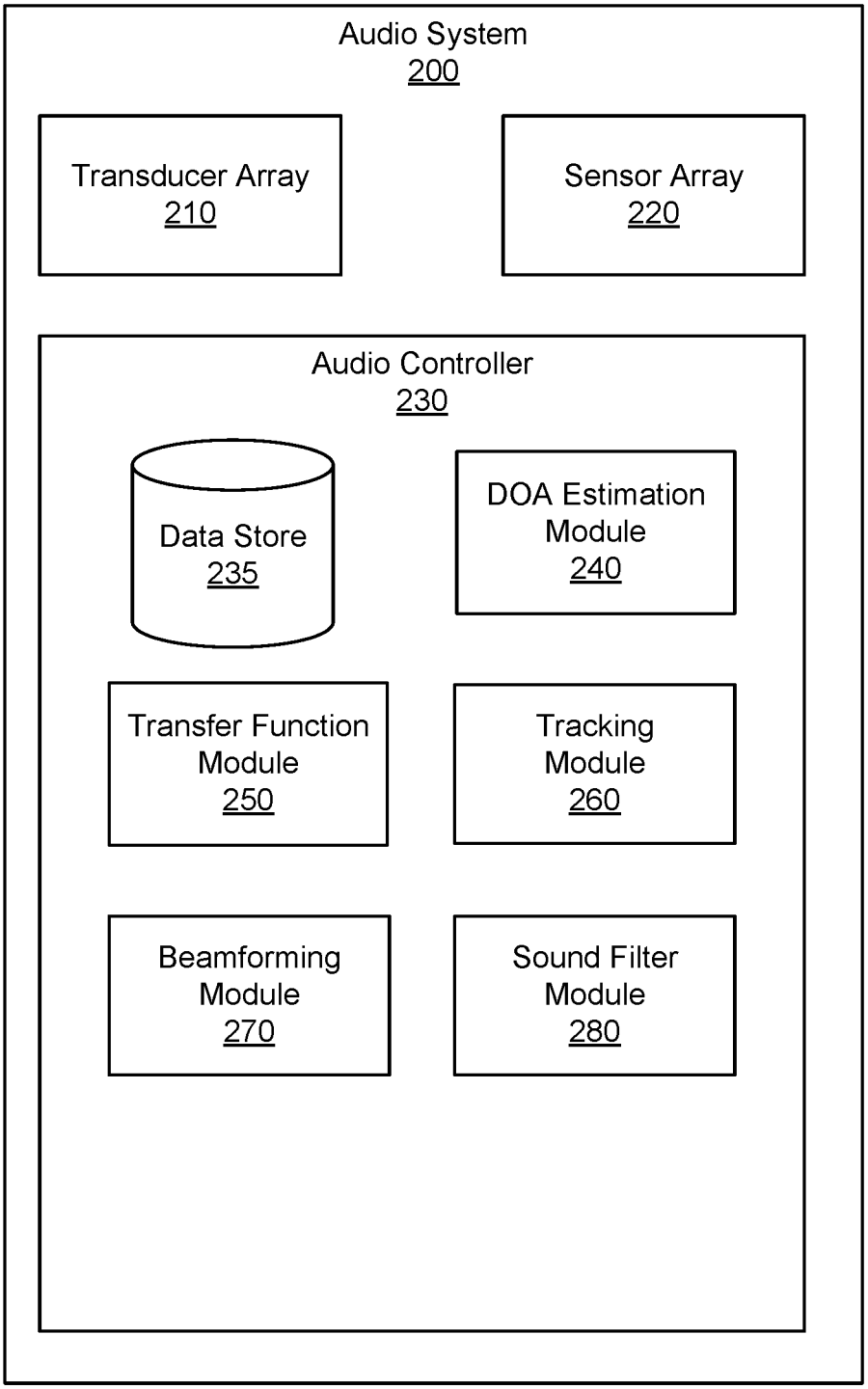
FIG. 2 is a block diagram of an audio system, in accordance with one or more embodiments.

FIG. 2 is a block diagram of an audio system 200, in accordance with one or more embodiments. The audio system in FIG. 1A or FIG. 1B may be an embodiment of the audio system 200. The audio system 200 generates one or more acoustic transfer functions for a user. The audio system 200 may then use the one or more acoustic transfer functions to generate audio content for the user. In the embodiment of FIG. 2, the audio system 200 includes a transducer array 210, a sensor array 220, and an audio controller 230. Some embodiments of the audio system 200 have different components than those described here. Similarly, in some cases, functions can be distributed among the components in a different manner than is described here.

The transducer array 210 is configured to present audio content. The transducer array 210 includes a pair of transducers, i.e., one transducer for each ear. A transducer is a device that provides audio content. A transducer may be, e.g., a speaker (e.g., the speaker 160), a tissue transducer (e.g., the tissue transducer 170), some other device that provides audio content, or some combination thereof. A tissue transducer may be configured to function as a bone conduction transducer or a cartilage conduction transducer. The transducer array 210 may present audio content via air conduction (e.g., via one or two speakers), via bone conduction (via one or two bone conduction transducer), via cartilage conduction audio system (via one or two cartilage conduction transducers), or some combination thereof.

The bone conduction transducers generate acoustic pressure waves by vibrating bone/tissue in the user's head. A bone conduction transducer may be coupled to a portion of a headset, and may be configured to be behind the auricle coupled to a portion of the user's skull. The bone conduction transducer receives vibration instructions from the audio controller 230, and vibrates a portion of the user's skull based on the received instructions. The vibrations from the bone conduction transducer generate a tissue-borne acoustic pressure wave that propagates toward the user's cochlea, bypassing the eardrum.

The cartilage conduction transducers generate acoustic pressure waves by vibrating one or more portions of the auricular cartilage of the ears of the user. A cartilage conduction transducer may be coupled to a portion of a headset, and may be configured to be coupled to one or more portions of the auricular cartilage of the ear. For example, the cartilage conduction transducer may couple to the back of an auricle of the ear of the user. The cartilage conduction transducer may be located anywhere along the auricular cartilage around the outer ear (e.g., the pinna, the tragus, some other portion of the auricular cartilage, or some combination thereof). Vibrating the one or more portions of auricular cartilage may generate: airborne acoustic pressure waves outside the ear canal; tissue born acoustic pressure waves that cause some portions of the ear canal to vibrate thereby generating an airborne acoustic pressure wave within the ear canal; or some combination thereof. The generated airborne acoustic pressure waves propagate down the ear canal toward the ear drum.

The transducer array 210 generates audio content in accordance with instructions from the audio controller 230. In some embodiments, the audio content is spatialized. Spatialized audio content is audio content that appears to originate from a particular direction and/or target region (e.g., an object in the local area and/or a virtual object). For example, spatialized audio content can make it appear that sound is originating from a virtual singer across a room from a user of the audio system 200. The transducer array 210 may be coupled to a wearable device (e.g., the headset 100 or the headset 105). In alternate embodiments, the transducer array 210 may be a pair of speakers that are separate from the wearable device (e.g., coupled to an external console).

The sensor array 220 detects sounds within a local area surrounding the sensor array 220. The sensor array 220 may include a plurality of acoustic sensors that each detect air pressure variations of a sound wave and convert the detected sounds into an electronic format (analog or digital). The plurality of acoustic sensors may be positioned on a headset (e.g., headset 100 and/or the headset 105), on a user (e.g., in an ear canal of the user), on a neckband, or some combination thereof. An acoustic sensor may be, e.g., a microphone, a vibration sensor, an accelerometer, or any combination thereof. In some embodiments, the sensor array 220 is configured to monitor the audio content generated by the transducer array 210 using at least some of the plurality of acoustic sensors. Increasing the number of sensors may improve the accuracy of information (e.g., directionality) describing a sound field produced by the transducer array 210 and/or sound from the local area.

The audio controller 230 controls operation of the audio system 200. In the embodiment of FIG. 2, the audio controller 230 includes a data store 235, a DOA estimation module 240, a transfer function module 250, a tracking module 260, a beamforming module 270, and a sound filter module 280. The audio controller 230 may be located inside a headset, in some embodiments. Some embodiments of the audio controller 230 have different components than those described here. Similarly, functions can be distributed among the components in different manners than described here. For example, some functions of the audio controller 230 may be performed external to the headset. The user may opt in to allow the audio controller 230 to transmit data captured by the headset to systems external to the headset, and the user may select privacy settings controlling access to any such data.

The data store 235 stores data for use by the audio system 200. Data in the data store 235 may include sounds recorded in the local area of the audio system 200, audio content, head-related transfer functions (HRTFs), transfer functions for one or more sensors, array transfer functions (ATFs) for one or more of the acoustic sensors, sound source locations, virtual model of local area, direction of arrival estimates, sound filters, virtual positions of sound sources, multi-source audio signals, signals for transducers (e.g., speakers) for each ear, and other data relevant for use by the audio system 200, or any combination thereof. The data store 235 may be implemented as a non-transitory computer-readable storage medium. In accordance with embodiments of the present disclosure, the data store 235 may act as a buffer to collect and store a plurality of sound signals each emitted from a corresponding (virtual) sound source of a plurality of sound sources. The plurality of sound sources may be, e.g., different peoples on a conference call with the user of the audio system 200.

The user may opt-in to allow the data store 235 to record data captured by the audio system 200. In some embodiments, the audio system 200 may employ always on recording, in which the audio system 200 records all sounds captured by the audio system 200 in order to improve the experience for the user. The user may opt in or opt out to allow or prevent the audio system 200 from recording, storing, or transmitting the recorded data to other entities.

The DOA estimation module 240 is configured to localize sound sources in the local area based in part on information from the sensor array 220. Localization is a process of determining where sound sources are located relative to the user of the audio system 200. The DOA estimation module 240 performs a DOA analysis to localize one or more sound sources within the local area. The DOA analysis may include analyzing the intensity, spectra, and/or arrival time of each sound at the sensor array 220 to determine the direction from which the sounds originated. In some cases, the DOA analysis may include any suitable algorithm for analyzing a surrounding acoustic environment in which the audio system 200 is located.

For example, the DOA analysis may be designed to receive input signals from the sensor array 220 and apply digital signal processing algorithms to the input signals to estimate a direction of arrival. These algorithms may include, for example, delay and sum algorithms where the input signal is sampled, and the resulting weighted and delayed versions of the sampled signal are averaged together to determine a DOA. A least mean squared (LMS) algorithm may also be implemented to create an adaptive filter. This adaptive filter may then be used to identify differences in signal intensity, for example, or differences in time of arrival. These differences may then be used to estimate the DOA. In another embodiment, the DOA may be determined by converting the input signals into the frequency domain and selecting specific bins within the time-frequency (TF) domain to process. Each selected TF bin may be processed to determine whether that bin includes a portion of the audio spectrum with a direct path audio signal. Those bins having a portion of the direct-path signal may then be analyzed to identify the angle at which the sensor array 220 received the direct-path audio signal. The determined angle may then be used to identify the DOA for the received input signal. Other algorithms not listed above may also be used alone or in combination with the above algorithms to determine DOA.

In some embodiments, the DOA estimation module 240 may also determine the DOA with respect to an absolute position of the audio system 200 within the local area. The position of the sensor array 220 may be received from an external system (e.g., some other component of a headset, an artificial reality console, a mapping server, a position sensor (e.g., the position sensor 190), etc.). The external system may create a virtual model of the local area, in which the local area and the position of the audio system 200 are mapped. The received position information may include a location and/or an orientation of some or all of the audio system 200 (e.g., of the sensor array 220). The DOA estimation module 240 may update the estimated DOA based on the received position information.

The transfer function module 250 is configured to generate one or more acoustic transfer functions. Generally, a transfer function is a mathematical function giving a corresponding output value for each possible input value. Based on parameters of the detected sounds, the transfer function module 250 generates one or more acoustic transfer functions associated with the audio system. The acoustic transfer functions may be ATFs, HRTFs, other types of acoustic transfer functions, or some combination thereof. An ATF characterizes how the microphone receives a sound from a point in space.

An ATF includes a number of transfer functions that characterize a relationship between the sound source and the corresponding sound received by the acoustic sensors in the sensor array 220. Accordingly, for a sound source there is a corresponding transfer function for each of the acoustic sensors in the sensor array 220. And collectively the set of transfer functions is referred to as an ATF. Accordingly, for each sound source there is a corresponding ATF. Note that the sound source may be, e.g., someone or something generating sound in the local area, the user, or one or more transducers of the transducer array 210. The ATF for a particular sound source location relative to the sensor array 220 may differ from user to user due to a person's anatomy (e.g., ear shape, shoulders, etc.) that affects the sound as it travels to the person's ears. Accordingly, the ATFs of the sensor array 220 are personalized for each user of the audio system 200.

In some embodiments, the transfer function module 250 determines one or more HRTFs for a user of the audio system 200. The HRTF characterizes how an ear receives a sound from a point in space. The HRTF for a particular source location relative to a person is unique to each ear of the person (and is unique to the person) due to the person's anatomy (e.g., ear shape, shoulders, etc.) that affects the sound as it travels to the person's ears. In some embodiments, the transfer function module 250 may determine HRTFs for the user using a calibration process. In some embodiments, the transfer function module 250 may provide information about the user to a remote system. The user may adjust privacy settings to allow or prevent the transfer function module 250 from providing the information about the user to any remote systems. The remote system determines a set of HRTFs that are customized to the user using, e.g., machine learning, and provides the customized set of HRTFs to the audio system 200.

The tracking module 260 is configured to track locations of one or more sound sources. The tracking module 260 may compare current DOA estimates and compare them with a stored history of previous DOA estimates. In some embodiments, the audio system 200 may recalculate DOA estimates on a periodic schedule, such as once per second, or once per millisecond. The tracking module may compare the current DOA estimates with previous DOA estimates, and in response to a change in a DOA estimate for a sound source, the tracking module 260 may determine that the sound source moved. In some embodiments, the tracking module 260 may detect a change in location based on visual information received from the headset or some other external source. The tracking module 260 may track the movement of one or more sound sources over time. The tracking module 260 may store values for a number of sound sources and a location of each sound source at each point in time. In response to a change in a value of the number or locations of the sound sources, the tracking module 260 may determine that a sound source moved. The tracking module 260 may calculate an estimate of the localization variance. The localization variance may be used as a confidence level for each determination of a change in movement.

The beamforming module 270 is configured to process one or more ATFs to selectively emphasize sounds from sound sources within a certain area while de-emphasizing sounds from other areas. In analyzing sounds detected by the sensor array 220, the beamforming module 270 may combine information from different acoustic sensors to emphasize sound associated from a particular region of the local area while deemphasizing sound that is from outside of the region. The beamforming module 270 may isolate an audio signal associated with sound from a particular sound source from other sound sources in the local area based on, e.g., different DOA estimates from the DOA estimation module 240 and the tracking module 260. The beamforming module 270 may thus selectively analyze discrete sound sources in the local area. In some embodiments, the beamforming module 270 may enhance a signal from a sound source. For example, the beamforming module 270 may apply sound filters which eliminate signals above, below, or between certain frequencies. Signal enhancement acts to enhance sounds associated with a given identified sound source relative to other sounds detected by the sensor array 220.

The sound filter module 280 determines sound filters for the transducer array 210. In some embodiments, the sound filters cause the audio content to be spatialized, such that the audio content appears to originate from a target region. The sound filter module 280 may use HRTFs and/or acoustic parameters to generate the sound filters. The acoustic parameters describe acoustic properties of the local area. The acoustic parameters may include, e.g., a reverberation time, a reverberation level, a room impulse response, etc. In some embodiments, the sound filter module 280 calculates one or more of the acoustic parameters. In some embodiments, the sound filter module 280 requests the acoustic parameters from a mapping server (e.g., as described below with regard to FIG. 5).

In some embodiments, the same (i.e., static) sound filters (e.g., the HRTFs) are applied for different positions of a user's head, thus locking virtual positions of sound sources relative to a user's head position, i.e., the virtual positions of sound sources are "head-locked." Alternatively, the sound filter module 280 may update the sound filters based on a user's head position, thus locking virtual positions of sound sources within the local area, i.e., the virtual positions of sound source locations are "world-locked." The sound filters determined by the sound filter module 280 may be associated with two audio channels of the audio system 200. In such case, the virtual sound sources appear at the same elevation. However, if the audio system 200 includes one or more additional audio channels (e.g., a total of three audio channels), one or more additional sound filters associated with additional audio channels can be applied, and the virtual sound sources may appear at different elevations, i.e., the virtual sound sources can be placed in the sound scene within any space points (e.g., three points in space). Similarly, as in the case of sound sources having the same elevation, virtual positions of sound sources with different elevations can be either head-locked or world-locked.

The sound filter module 280 provides the sound filters to the transducer array 210. In some embodiments, the sound filters may cause positive or negative amplification of sounds as a function of frequency. Additional details about application of the sound filters are described in connection with FIG. 3A.

Figure 3A:
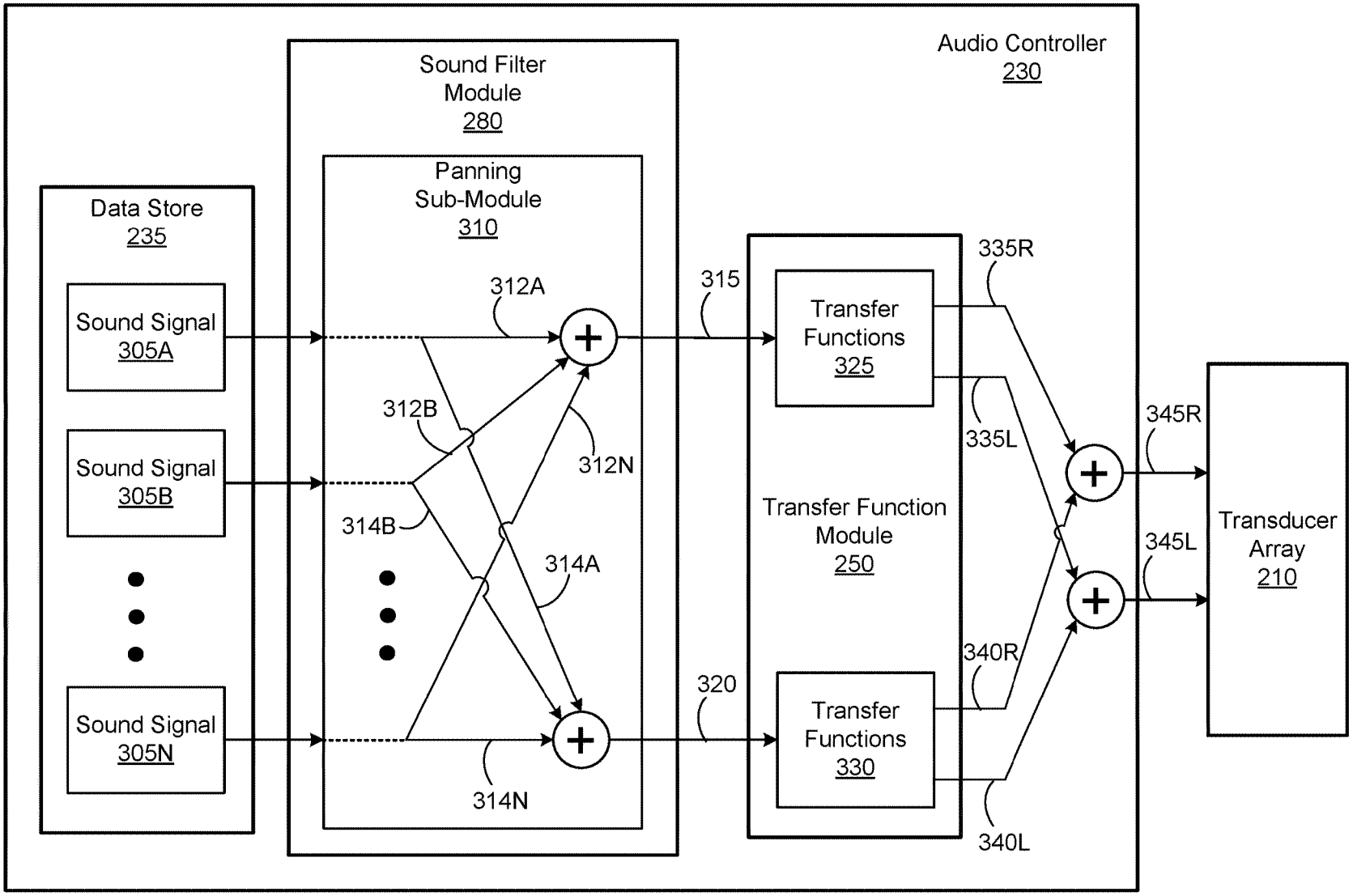
FIG. 3A is a block diagram of a discrete binaural spatialization of discrete sound sources that is implemented at the audio system of FIG. 2, in accordance with one or more embodiments.

FIG. 3A is a block diagram of a discrete binaural spatialization of a plurality of discrete sound sources that is implemented at the audio system 200, in accordance with one or more embodiments. The data store 235 may record and collect a plurality of sound signals 305A, 305B, . . . , 305N (i.e., more than two sound signals) each emitted from a corresponding sound source of the plurality of sound sources. Thus, the data store 235 may act as a memory buffer. The plurality of sound sources may be, e.g., different peoples on a conference call with a user of the audio system 200. Alternatively, the sound signals 305A, 305B, . . . , 305N may be collected at some other module of the audio controller 230, or at a computing device (e.g., a smartphone, console, remote server, etc.) that is interfaced (e.g., via a wireless connection) with the audio system 200 and the audio controller 230.

The audio controller 230 may assign to each sound source a respective virtual position within an angular range of a sound scene around the audio system 200. For example, the angular range of the sound scene can be 120°, e.g., spanning between −60° and +60°. Virtual positions assigned to all sound sources may be located within the sound scene at a same elevation. In an embodiment, the sound sources are placed in the horizontal plane in front of the user having an elevation of 0°. In another embodiment, the sound sources are placed below the horizon, e.g., with an angular elevation of −30°. In yet another embodiment, the sound sources are placed above the horizon, e.g., with an angular elevation of +30°. In yet another embodiment, the sound sources are distributed in the sound scene across a diagonal.

In some embodiments, virtual positions can be assigned to the sound sources in accordance with a uniform distribution of the virtual positions within the angular range, i.e., the assigned virtual positions can be equally separated from each other within the angular range of the sound scene, which provides maximized speech intelligibility among the sound sources. In general, when the sound sources having the same elevation are equally distributed within the sound scene, an angular separation between each two adjacent virtual positions of is equal to AR/(NS−1), where AR is an angular range (e.g., 120°) and NS is a number of independent sound sources to be equally distributed within the sound scene. Equal spatial separation of virtual positions of sound sources that have different elevations within the sound scene may also provide maximized speech intelligibility. In some other embodiments, virtual positions can be assigned to the sound sources in accordance with one or more other distributions.

In an embodiment, there are only four independent sound signals, 305A-D. In such case, four independent sound sources each emitting a corresponding independent sound signal 305A-D can be equally distributed within a sound scene for a user's perception. The sound signals 305A-D may be recorded and collected at the data store 235. A first virtual position matching a first boundary of the angular range can be assigned to a first sound source from which the sound signal 305A originates, e.g., the first virtual position may have an angular direction within the sound scene of +60°. Similarly, a fourth virtual position matching a second boundary of the angular range can be assigned to a fourth sound source from which the sound signal 305D originates, e.g., the fourth virtual position may have an angular direction in the sound scene of −60°. A second virtual position can be assigned to a second sound source from which the sound signal 305B originates having an angular direction in the sound scene of +20°. Lastly, a third virtual position can be assigned to a third sound source from which the sound signal 305C originates having an angular direction in the sound scene of −20°. Thus, in the case of NS=4 independent sound sources, an angular separation between each two adjacent virtual positions is 120°/3=40°.

In another embodiment, at least a portion of sound sources are assigned over a non-uniform spacing within a sound scene, e.g., between −20° and +60°. In addition, at least one sound source (e.g., the loudest sound source) can be placed within the sound scene outside of an angular range where the other sound sources are assigned to. For example, the loudest sound source can be assigned to a virtual position having an angular direction of −50°. A user's perception of the sound sources with substantial difference in loudness may improve if the sound sources are not placed within the sound scene to overlap each other. In general, greater spatial separation(s) of louder sound sources would allow for greater intelligibility of quieter sound sources.

A panning sub-module 310 of the audio controller 230 may perform panning of each sound signal 305A, 305B, . . . , 305N retrieved from the data store 235 according to a respective virtual position of each sound source to generate a first multi-source audio signal 315 and a second multi-source audio signal 320. Information about respective virtual positions assigned to the sound sources is known to the panning sub-module 310, e.g., the information about the respective virtual positions may be obtained from the data store 235. The first multi-source audio signal 315 can be associated with a first direction of the angular range of the sound scene. The first direction of the angular range may match a first boundary of the angular range, e.g., a boundary having an angular direction of +60° within the sound scene. The second multi-source audio signal 320 can be associated with a second direction of the angular range of the sound scene. The second direction of the angular range may match a second boundary of the angular range, e.g., a boundary having an angular direction of −60° within the sound scene.

The panning performed by the panning sub-module 310 may be achieved by splitting an energy of each sound signal 305A, 305B, . . . , 305N between a first energy associated with the first direction and a second energy associated with the second direction, based on the respective virtual position of each sound source. The panning may be performed in parallel for all sound signals 305A, 305B, . . . , 305N. As shown in FIG. 3A, the panning sub-module 310 may split an energy of the sound signal 305A into an energy of a sound signal 312A associated with the first direction and an energy of sound signal 314A associated with the second direction. Similarly, the panning sub-module 310 may split an energy of the sound signal 305B into an energy of a sound signal 312B associated with the first direction and an energy of sound signal 314B associated with the second direction, etc., and the panning sub-module 310 may split an energy of the sound signal 305N into an energy of a sound signal 312N associated with the first direction and an energy of sound signal 314N associated with the second direction.

The first multi-source audio signal 315 may be generated by summing all sound signals 312A, 312B, . . . , 312N associated with the first direction. Similarly, the second multi-source audio signal 320 may be generated by summing all sound signals 314A, 314B, . . . , 314N associated with the second direction. In some embodiments, if a virtual position assigned to a sound source generating the sound signal 305A matches the first direction, the energy of sound signal 314A would be zero. Similarly, if a virtual position assigned to a sound source generating the sound signal 305N matches the second direction, the energy of sound signal 312N would be zero.

The panning sub-module 310 may be configured to perform panning of the sound signals 305A, 305B, . . . , 305N in accordance with a linear panning law, an energetic panning law, a circular panning law, a constant power panning law, some other panning law, or combination thereof. As illustrated in FIG. 3A, the panning sub-module 310 may be part of the sound filter module 280. Alternatively, the panning sub-module 310 may be part of some other module of the audio controller 230, e.g., part of the DOE estimation module 240, the transfer function module, or the beamforming module 270. In another embodiment, the panning sub-module 310 is a stand-alone module of the audio controller 230. In yet another embodiment, the panning sub-module 310 is integrated into the computing device separate from the audio system 200.

The first multi-source audio signal 315 may be fed onto a first audio channel of the audio system 200 for spatialization by the transfer functions 325. Similarly, the second multi-source audio signal 320 may be fed onto a second audio channel of the audio system 200 for spatialization by the transfer functions 330. The transfer functions 325 may perform spatialization of the first multi-source audio signal 315 to the first direction to generate a first right signal 335R and a first left signal 335L. The transfer functions 325 may be a pair of HRTFs or some other pair of spatial filters for both user's ears associated with the first direction, e.g., having an angular direction of +60°. The transfer functions 330 may perform spatialization of the second multi-source audio signal 320 to the second direction to generate a second right signal 340R and a second left signal 340L. The transfer functions 330 may be a pair of HRTFs or some other pair of spatial filters for both user's ears associated with the second direction, e.g., having an angular direction of −60°.

In some embodiments, the same transfer functions 325, 330 are used for different positions of a user's head. In such cases, as an orientation of the user's hand changes, locations of the virtual positions of the sound sources would also move within the sound scene so that the virtual positions of the sound sources relative to the orientation of the user's hand remain fixed. In some other embodiments, the transfer functions 325, 330 are updated (i.e., different transfer functions 325, 330 may be retrieved from the transfer function module 250) based on a movement of the user's head so that each sound source appears to the user to originate from the respective virtual position that is fixed within the sound scene. As illustrated in FIG. 3A, the transfer functions 325, 330 applied to the first and second multi-source audio signal 315. 320 may be part of the transfer function module 250. Alternatively, the transfer functions 325, 330 may be part of some other module of the audio controller 230, e.g., part of the sound filter module 280.

The audio controller 230 may generate a binaural signal 345R, 345L using the first right signal 335R, the first left signal 335L, the second right signal 340R, and the second left signal 340L. The binaural signal 345R, 345L may be such that each sound source appears to originate from the respective virtual position. A right component 345R of the binaural signal for presentation to a right ear of the user may be generated by summing the first right signal 335R and the second right signal 340R. Similarly, a left component 345L of the binaural signal for presentation to a left ear of the user may be generated by summing the first left signal 335L and the second left signal 340L. The binaural signal 345R, 345L may be provided to the transducer array 210 for presentation to the user of the audio system. For example, the right component 345R may be provided to a corresponding speaker 160 and/or a corresponding tissue transducer 170 generating acoustic pressure waves for the right ear. Similarly, the left component 345L may be provided to a corresponding speaker 160 and/or a corresponding tissue transducer 170 generating acoustic pressure waves for the left ear.

Figure 3B:
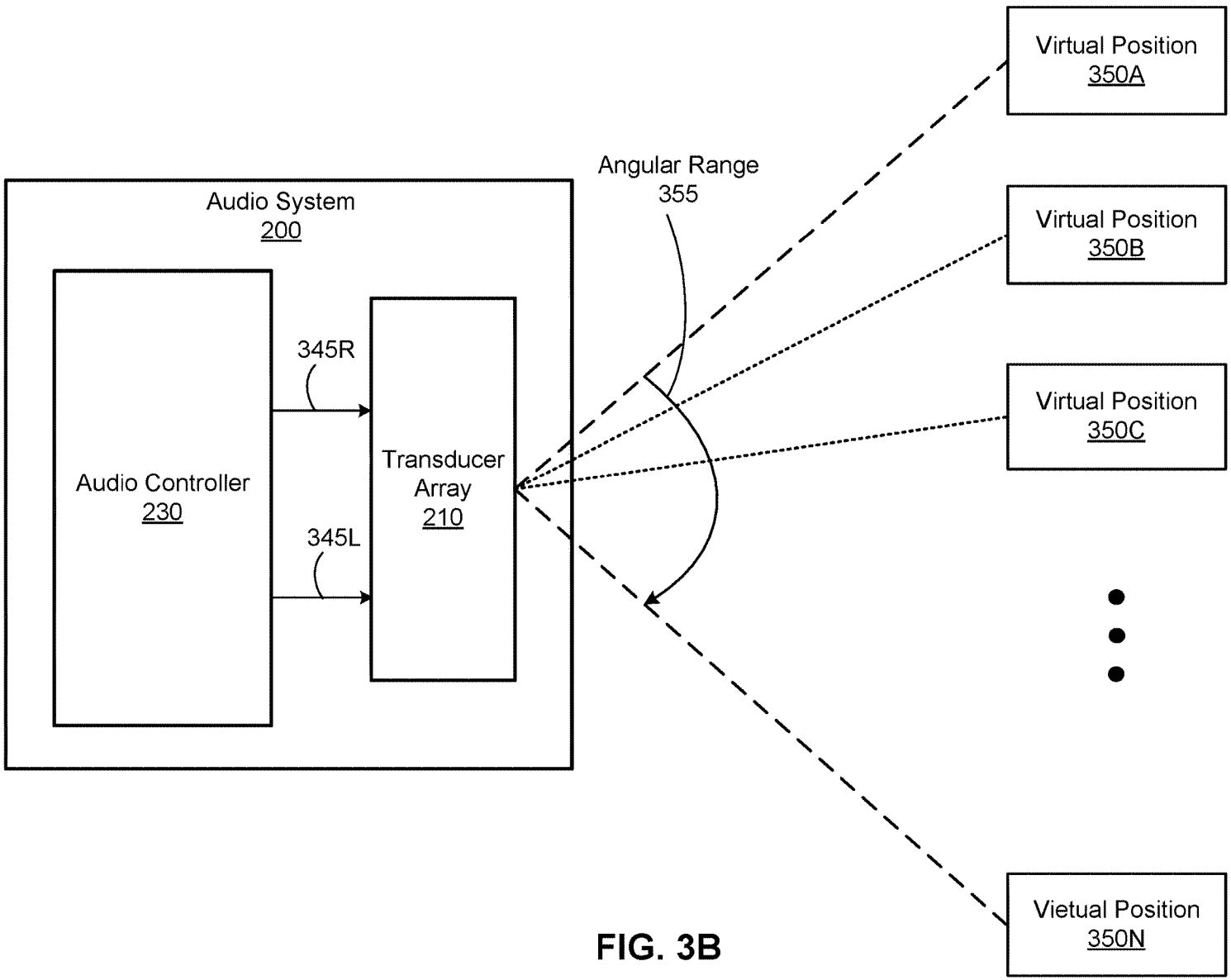
FIG. 3B illustrates virtual positions of the sound sources in a sound scene resulting from the discrete binaural spatialization of FIG. 3A, in accordance with one or more embodiments.

FIG. 3B illustrates virtual positions of the sound sources (i.e., perceived source positions) in a sound scene resulting from the discrete binaural spatialization of FIG. 3A, in accordance with one or more embodiments. The audio controller 230 of the audio system may perform a discrete binaural spatialization of a plurality of sound sources (e.g., sound sources emitting sound signals 305A, 305B, 305C, . . . , 305N) to generate the right and left components 345R, 345L of the binaural signal, as shown in FIG. 3A. The right and left components 345R, 345L of the binaural signal may be then provided to the transducer array 210 of the audio system 200 for presentation to the user. The user perceives the sound signals 305A, 305B, 305C, . . . , 305N as originating from virtual positions 350A, 350B, 350C, . . . , 350N, respectively, within an angular range 355. As discussed above, the virtual positions 350A, 350B, 350C, . . . , 350N may be uniformly distributed within the angular range 355. However, some other distribution of virtual positions 350A, 350B, 350C, . . . , 350N is possible.

Figure 4:
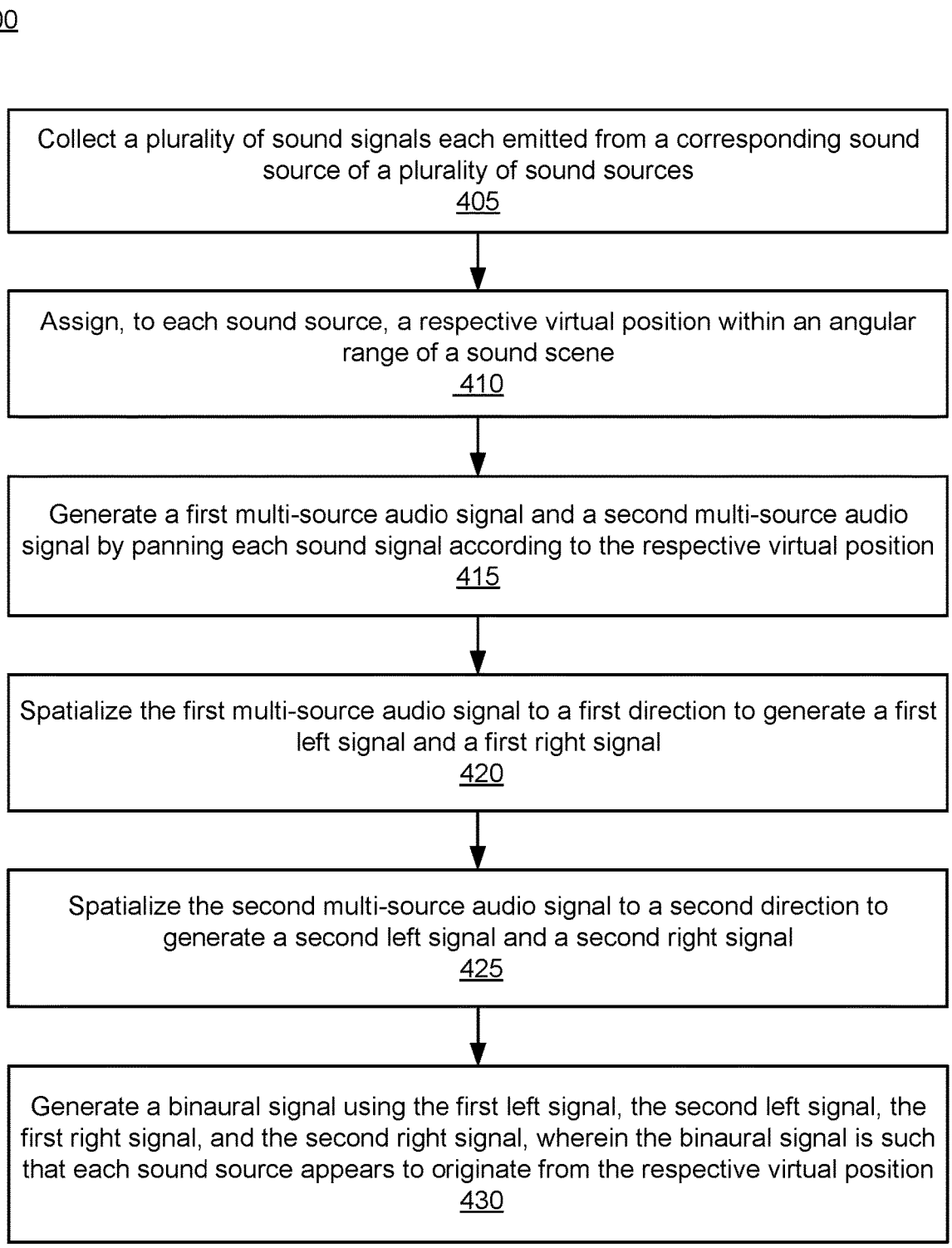
FIG. 4 is a flowchart illustrating a process for discrete binaural spatialization of multiple sound sources, in accordance with one or more embodiments.

FIG. 4 is a flowchart of a method 400 of discrete binaural spatialization of a plurality of sound sources, in accordance with one or more embodiments. The process shown in FIG. 4 may be performed by components of an audio system (e.g., the audio system 200). Other entities may perform some or all of the steps in FIG. 4 in other embodiments. Embodiments may include different and/or additional steps, or perform the steps in different orders.

The audio system collects 405 (e.g., at the data store 235) a plurality of sound signals each emitted from a corresponding sound source of the plurality of sound sources. The plurality of sound sources may be, e.g., different peoples on a conference call with a user of the audio system. The audio system may collect 405 the plurality of sound signals by, e.g., buffering the sound signals that are incoming from the sound sources during each predefined time period of one or more time periods of the conference call.

The audio system assigns 410 (e.g., by the audio controller 230), to each sound source, a respective virtual position within an angular range of a sound scene. The angular range may be, e.g., between −60° and +60° for a total angular range of 120°. The angular range may be equally divided among the plurality of sound sources into a plurality of angular directions, and the respective virtual position assigned to each sound source may correspond to a respective angular direction. Alternatively, the plurality of sound sources may be non-equally distributed, i.e., angular separations between adjacent sound sources may be different.

The audio system generates 415 (e.g., by the audio controller 230) a first multi-source audio signal and a second multi-source audio signal by panning each sound signal according to the respective virtual position. The audio system may generate the first and second multi-source audio signals by splitting an energy of each sound signal between a first energy associated with a first direction and a second energy associated with a second direction, based on the respective virtual position. The first direction may match a first boundary of the angular range, and the second direction may match a second boundary of the angular range. The audio system may sum a first corresponding portion of each sound signal (e.g., associated with the first direction) to generate the first multi-source audio signal. The audio system may further sum a second corresponding portion of each sound signal (e.g., associated with the second direction) to generate the second multi-source audio signal.

The audio system spatializes 420 (e.g., by the audio controller 230) the first multi-source audio signal to the first direction to generate a first left signal and a first right signal. The audio system may spatialize the first multi-source audio signal by applying to the first multi-source audio signal a first pair of HRTFs (e.g., for both user's ears) associated with the first direction. The audio system may apply first spatial filters (e.g., for both user's ears) to the first multi-source audio signal to spatialize the first multi-source audio signal to the first direction. The audio system may update the first spatial filters (e.g., the first pair of HRTFs) based on a movement of a head of the user so that each sound source appears to originate from the respective virtual position that is fixed within the sound scene.

The audio system spatializes 425 (e.g., by the audio controller 230) the second multi-source audio signal to the second direction to generate a second left signal and a second right signal. The audio system may spatialize the second multi-source audio signal by applying to the second multi-source audio signal a second pair of HRTFs (e.g., for both user's ears) associated with the second direction. The audio system may apply second spatial filters (e.g., for both user's ears) to the second multi-source audio signal to spatialize the second multi-source audio signal to the second direction. The audio system may update the second spatial filters (e.g., the second pair of HRTFs) based on the movement of the user's head so that each sound source appears to originate from the respective virtual position that is fixed within the sound scene.

The audio system generates 430 (e.g., by the audio controller 230) a binaural signal using the first left signal, the second left signal, the first right signal, and the second right signal, wherein the binaural signal is such that each sound source appears to originate from the respective virtual position. The audio system may generate a left component of the binaural signal for presentation to a left ear of the user by summing the first left signal and the second left signal. The audio system may generate a right component of the binaural signal for presentation to a right ear of the user by summing the first right signal and the second right signal. The audio system may present the binaural signal to the user, e.g., via the transducer array 210.

System Environment

Figure 5:
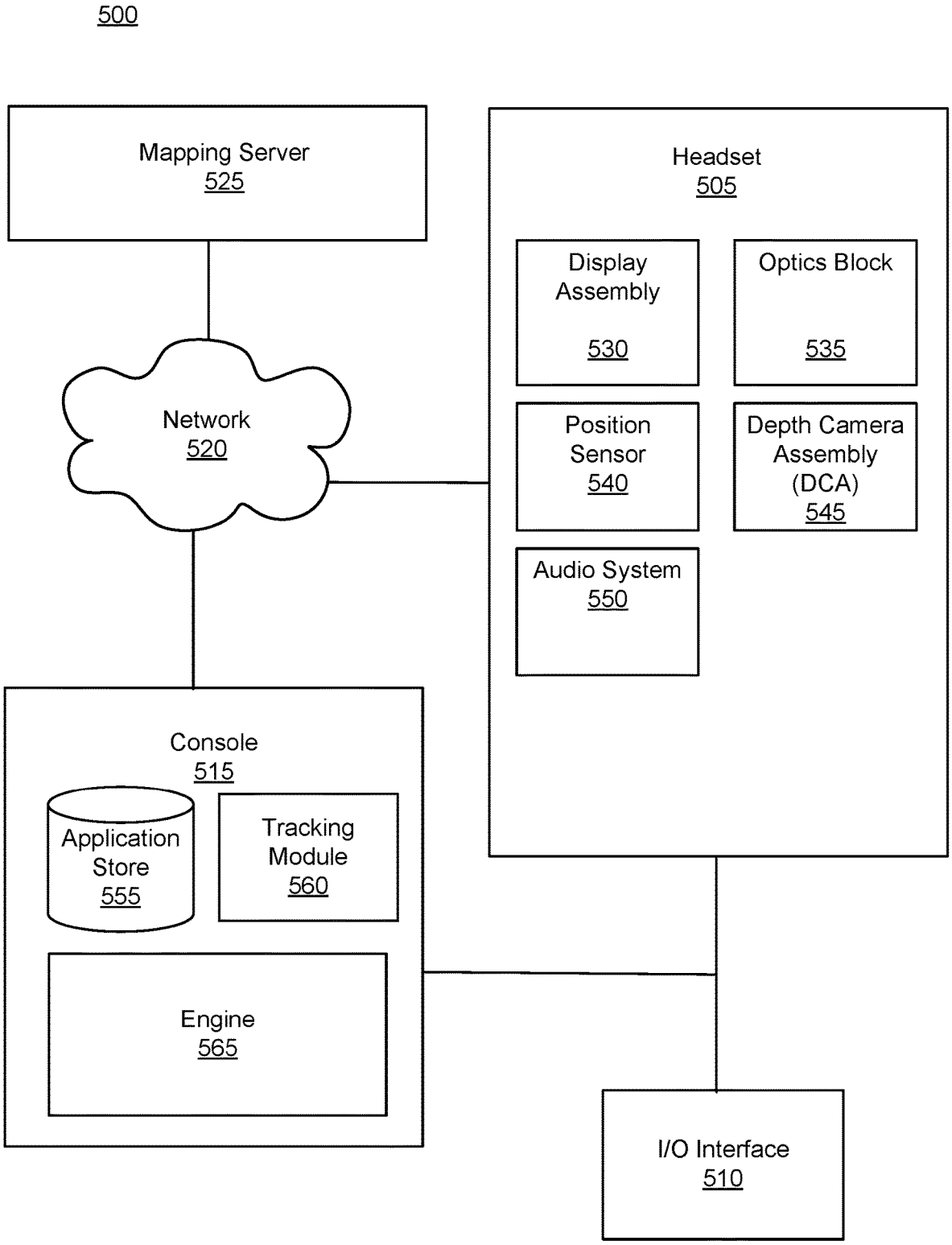
FIG. 5 is a system that includes a headset, in accordance with one or more embodiments.

FIG. 5 is a system 500 that includes a headset 505, in accordance with one or more embodiments. In some embodiments, the headset 505 may be the headset 100 of FIG. 1A or the headset 105 of FIG. 1B. The system 500 may operate in an artificial reality environment (e.g., a virtual reality environment, an augmented reality environment, a mixed reality environment, or some combination thereof). The system 500 shown by FIG. 5 includes the headset 505, an input/output (I/O) interface 510 that is coupled to a console 515, the network 520, and the mapping server 525. While FIG. 5 shows an example system 500 including one headset 505 and one I/O interface 510, in other embodiments any number of these components may be included in the system 500. For example, there may be multiple headsets each having an associated I/O interface 510, with each headset and I/O interface 510 communicating with the console 515. In alternative configurations, different and/or additional components may be included in the system 500. Additionally, functionality described in conjunction with one or more of the components shown in FIG. 5 may be distributed among the components in a different manner than described in conjunction with FIG. 5 in some embodiments. For example, some or all of the functionality of the console 515 may be provided by the headset 505.

The headset 505 includes the display assembly 530, an optics block 535, one or more position sensors 540, and the DCA 545. Some embodiments of headset 505 have different components than those described in conjunction with FIG. 5. Additionally, the functionality provided by various components described in conjunction with FIG. 5 may be differently distributed among the components of the headset 505 in other embodiments, or be captured in separate assemblies remote from the headset 505.

The display assembly 530 displays content to the user in accordance with data received from the console 515. The display assembly 530 displays the content using one or more display elements (e.g., the display elements 120). A display element may be, e.g., an electronic display. In various embodiments, the display assembly 530 comprises a single display element or multiple display elements (e.g., a display for each eye of a user). Examples of an electronic display include: a liquid crystal display (LCD), an organic light emitting diode (OLED) display, an active-matrix organic light-emitting diode display (AMOLED), a waveguide display, some other display, or some combination thereof. Note in some embodiments, the display element 120 may also include some or all of the functionality of the optics block 535.

The optics block 535 may magnify image light received from the electronic display, corrects optical errors associated with the image light, and presents the corrected image light to one or both eye boxes of the headset 505. In various embodiments, the optics block 535 includes one or more optical elements. Example optical elements included in the optics block 535 include: an aperture, a Fresnel lens, a convex lens, a concave lens, a filter, a reflecting surface, or any other suitable optical element that affects image light. Moreover, the optics block 535 may include combinations of different optical elements. In some embodiments, one or more of the optical elements in the optics block 535 may have one or more coatings, such as partially reflective or anti-reflective coatings.

Magnification and focusing of the image light by the optics block 535 allows the electronic display to be physically smaller, weigh less, and consume less power than larger displays. Additionally, magnification may increase the field of view of the content presented by the electronic display. For example, the field of view of the displayed content is such that the displayed content is presented using almost all (e.g., approximately 110 degrees diagonal), and in some cases, all of the user's field of view. Additionally, in some embodiments, the amount of magnification may be adjusted by adding or removing optical elements.

In some embodiments, the optics block 535 may be designed to correct one or more types of optical error. Examples of optical error include barrel or pincushion distortion, longitudinal chromatic aberrations, or transverse chromatic aberrations. Other types of optical errors may further include spherical aberrations, chromatic aberrations, or errors due to the lens field curvature, astigmatisms, or any other type of optical error. In some embodiments, content provided to the electronic display for display is pre-distorted, and the optics block 535 corrects the distortion when it receives image light from the electronic display generated based on the content.

The position sensor 540 is an electronic device that generates data indicating a position of the headset 505. The position sensor 540 generates one or more measurement signals in response to motion of the headset 505. The position sensor 190 is an embodiment of the position sensor 540. Examples of a position sensor 540 include: one or more IMUs, one or more accelerometers, one or more gyroscopes, one or more magnetometers, another suitable type of sensor that detects motion, or some combination thereof. The position sensor 540 may include multiple accelerometers to measure translational motion (forward/back, up/down, left/right) and multiple gyroscopes to measure rotational motion (e.g., pitch, yaw, roll). In some embodiments, an IMU rapidly samples the measurement signals and calculates the estimated position of the headset 505 from the sampled data. For example, the IMU integrates the measurement signals received from the accelerometers over time to estimate a velocity vector and integrates the velocity vector over time to determine an estimated position of a reference point on the headset 505. The reference point is a point that may be used to describe the position of the headset 505. While the reference point may generally be defined as a point in space, however, in practice the reference point is defined as a point within the headset 505.

The DCA 545 generates depth information for a portion of the local area. The DCA includes one or more imaging devices and a DCA controller. The DCA 545 may also include an illuminator. Operation and structure of the DCA 545 is described above with regard to FIG. IA.

The audio system 550 provides audio content to a user of the headset 505. The audio system 550 is substantially the same as the audio system 200 described above. The audio system 550 may comprise one or acoustic sensors, one or more transducers, and an audio controller. The audio system 550 may provide spatialized audio content to the user. In accordance with embodiments of the present disclosure, the audio system 550 performs the discrete binaural spatialization of more than two sound sources on its two audio channels for presentation of audio content to the user. The audio system 550 may generate a pair of multi-source audio signals by panning sound signal from the sound sources according to their pre-assigned virtual positions within a sound scene. The pair of multi-source audio signals may be transmitted to the two audio channels of the audio system 550 and transformed into a binaural signal for presentation to the user by applying appropriate sound filters. The binaural signal may be such that each sound source appears to originate from its respective virtual position within the sound scene. In some embodiments, the audio system 550 may request acoustic parameters from the mapping server 525 over the network 520. The acoustic parameters describe one or more acoustic properties (e.g., room impulse response, a reverberation time, a reverberation level, etc.) of the local area. The audio system 550 may provide information describing at least a portion of the local area from e.g., the DCA 545 and/or location information for the headset 505 from the position sensor 540. The audio system 550 may generate one or more sound filters using one or more of the acoustic parameters received from the mapping server 525, and use the sound filters to provide audio content to the user.

The I/O interface 510 is a device that allows a user to send action requests and receive responses from the console 515. An action request is a request to perform a particular action. For example, an action request may be an instruction to start or end capture of image or video data, or an instruction to perform a particular action within an application. The I/O interface 510 may include one or more input devices. Example input devices include: a keyboard, a mouse, a game controller, or any other suitable device for receiving action requests and communicating the action requests to the console 515. An action request received by the I/O interface 510 is communicated to the console 515, which performs an action corresponding to the action request. In some embodiments, the I/O interface 510 includes an IMU that captures calibration data indicating an estimated position of the I/O interface 510 relative to an initial position of the I/O interface 510. In some embodiments, the I/O interface 510 may provide haptic feedback to the user in accordance with instructions received from the console 515. For example, haptic feedback is provided when an action request is received, or the console 515 communicates instructions to the I/O interface 510 causing the I/O interface 510 to generate haptic feedback when the console 515 performs an action.

The console 515 provides content to the headset 505 for processing in accordance with information received from one or more of: the DCA 545, the headset 505, and the I/O interface 510. In the example shown in FIG. 5, the console 515 includes an application store 555, a tracking module 560, and an engine 565. Some embodiments of the console 515 have different modules or components than those described in conjunction with FIG. 5. Similarly, the functions further described below may be distributed among components of the console 515 in a different manner than described in conjunction with FIG. 5. In some embodiments, the functionality discussed herein with respect to the console 515 may be implemented in the headset 505, or a remote system.

The application store 555 stores one or more applications for execution by the console 515. An application is a group of instructions, that when executed by a processor, generates content for presentation to the user. Content generated by an application may be in response to inputs received from the user via movement of the headset 505 or the I/O interface 510. Examples of applications include: gaming applications, conferencing applications, video playback applications, or other suitable applications.

The tracking module 560 tracks movements of the headset 505 or of the I/O interface 510 using information from the DCA 545, the one or more position sensors 540, or some combination thereof. For example, the tracking module 560 determines a position of a reference point of the headset 505 in a mapping of a local area based on information from the headset 505. The tracking module 560 may also determine positions of an object or virtual object. Additionally, in some embodiments, the tracking module 560 may use portions of data indicating a position of the headset 505 from the position sensor 540 as well as representations of the local area from the DCA 545 to predict a future location of the headset 505. The tracking module 560 provides the estimated or predicted future position of the headset 505 or the I/O interface 510 to the engine 565.

The engine 565 executes applications and receives position information, acceleration information, velocity information, predicted future positions, or some combination thereof, of the headset 505 from the tracking module 560. Based on the received information, the engine 565 determines content to provide to the headset 505 for presentation to the user. For example, if the received information indicates that the user has looked to the left, the engine 565 generates content for the headset 505 that mirrors the user's movement in a virtual local area or in a local area augmenting the local area with additional content. Additionally, the engine 565 performs an action within an application executing on the console 515 in response to an action request received from the I/O interface 510 and provides feedback to the user that the action was performed. The provided feedback may be visual or audible feedback via the headset 505 or haptic feedback via the I/O interface 510.

The network 520 couples the headset 505 and/or the console 515 to the mapping server 525. The network 520 may include any combination of local area and/or wide area networks using both wireless and/or wired communication systems. For example, the network 520 may include the Internet, as well as mobile telephone networks. In one embodiment, the network 520 uses standard communications technologies and/or protocols. Hence, the network 520 may include links using technologies such as Ethernet, 802.11, worldwide interoperability for microwave access (WiMAX), 2G/3G/4G mobile communications protocols, digital subscriber line (DSL), asynchronous transfer mode (ATM), InfiniBand, PCI Express Advanced Switching, etc. Similarly, the networking protocols used on the network 520 can include multiprotocol label switching (MPLS), the transmission control protocol/Internet protocol (TCP/IP), the User Datagram Protocol (UDP), the hypertext transport protocol (HTTP), the simple mail transfer protocol (SMTP), the file transfer protocol (FTP), etc. The data exchanged over the network 520 can be represented using technologies and/or formats including image data in binary form (e.g. Portable Network Graphics (PNG)), hypertext markup language (HTML), extensible markup language (XML), etc. In addition, all or some of links can be encrypted using conventional encryption technologies such as secure sockets layer (SSL), transport layer security (TLS), virtual private networks (VPNs), Internet Protocol security (IPsec), etc.

The mapping server 525 may include a database that stores a virtual model describing a plurality of spaces, wherein one location in the virtual model corresponds to a current configuration of a local area of the headset 505. The mapping server 525 receives, from the headset 505 via the network 520, information describing at least a portion of the local area and/or location information for the local area. The user may adjust privacy settings to allow or prevent the headset 505 from transmitting information to the mapping server 525. The mapping server 525 determines, based on the received information and/or location information, a location in the virtual model that is associated with the local area of the headset 505. The mapping server 525 determines (e.g., retrieves) one or more acoustic parameters associated with the local area, based in part on the determined location in the virtual model and any acoustic parameters associated with the determined location. The mapping server 525 may transmit the location of the local area and any values of acoustic parameters associated with the local area to the headset 505.

One or more components of system 500 may contain a privacy module that stores one or more privacy settings for user data elements. The user data elements describe the user or the headset 505. For example, the user data elements may describe a physical characteristic of the user, an action performed by the user, a location of the user of the headset 505, a location of the headset 505, HRTFs for the user, etc. Privacy settings (or "access settings") for a user data element may be stored in any suitable manner, such as, for example, in association with the user data element, in an index on an authorization server, in another suitable manner, or any suitable combination thereof.

A privacy setting for a user data element specifies how the user data element (or particular information associated with the user data element) can be accessed, stored, or otherwise used (e.g., viewed, shared, modified, copied, executed, surfaced, or identified). In some embodiments, the privacy settings for a user data element may specify a "blocked list" of entities that may not access certain information associated with the user data element. The privacy settings associated with the user data element may specify any suitable granularity of permitted access or denial of access. For example, some entities may have permission to see that a specific user data element exists, some entities may have permission to view the content of the specific user data element, and some entities may have permission to modify the specific user data element. The privacy settings may allow the user to allow other entities to access or store user data elements for a finite period of time.

The privacy settings may allow a user to specify one or more geographic locations from which user data elements can be accessed. Access or denial of access to the user data elements may depend on the geographic location of an entity who is attempting to access the user data elements. For example, the user may allow access to a user data element and specify that the user data element is accessible to an entity only while the user is in a particular location. If the user leaves the particular location, the user data element may no longer be accessible to the entity. As another example, the user may specify that a user data element is accessible only to entities within a threshold distance from the user, such as another user of a headset within the same local area as the user. If the user subsequently changes location, the entity with access to the user data element may lose access, while a new group of entities may gain access as they come within the threshold distance of the user.

The system 500 may include one or more authorization/privacy servers for enforcing privacy settings. A request from an entity for a particular user data element may identify the entity associated with the request and the user data element may be sent only to the entity if the authorization server determines that the entity is authorized to access the user data element based on the privacy settings associated with the user data element. If the requesting entity is not authorized to access the user data element, the authorization server may prevent the requested user data element from being retrieved or may prevent the requested user data element from being sent to the entity. Although this disclosure describes enforcing privacy settings in a particular manner, this disclosure contemplates enforcing privacy settings in any suitable manner.

Additional Configuration Information

The foregoing description of the embodiments has been presented for illustration; it is not intended to be exhaustive or to limit the patent rights to the precise forms disclosed. Persons skilled in the relevant art can appreciate that many modifications and variations are possible considering the above disclosure.

Some portions of this description describe the embodiments in terms of algorithms and symbolic representations of operations on information. These algorithmic descriptions and representations are commonly used by those skilled in the data processing arts to convey the substance of their work effectively to others skilled in the art. These operations, while described functionally, computationally, or logically, are understood to be implemented by computer programs or equivalent electrical circuits, microcode, or the like. Furthermore, it has also proven convenient at times, to refer to these arrangements of operations as modules, without loss of generality. The described operations and their associated modules may be embodied in software, firmware, hardware, or any combinations thereof.

Any of the steps, operations, or processes described herein may be performed or implemented with one or more hardware or software modules, alone or in combination with other devices. In one embodiment, a software module is implemented with a computer program product comprising a computer-readable medium containing computer program code, which can be executed by a computer processor for performing any or all the steps, operations, or processes described.

Embodiments may also relate to an apparatus for performing the operations herein. This apparatus may be specially constructed for the required purposes, and/or it may comprise a general-purpose computing device selectively activated or reconfigured by a computer program stored in the computer. Such a computer program may be stored in a non-transitory, tangible computer readable storage medium, or any type of media suitable for storing electronic instructions, which may be coupled to a computer system bus. Furthermore, any computing systems referred to in the specification may include a single processor or may be architectures employing multiple processor designs for increased computing capability.

Embodiments may also relate to a product that is produced by a computing process described herein. Such a product may comprise information resulting from a computing process, where the information is stored on a non-transitory, tangible computer readable storage medium and may include any embodiment of a computer program product or other data combination described herein.

Finally, the language used in the specification has been principally selected for readability and instructional purposes, and it may not have been selected to delineate or circumscribe the patent rights. It is therefore intended that the scope of the patent rights be limited not by this detailed description, but rather by any claims that issue on an application based hereon. Accordingly, the disclosure of the embodiments is intended to be illustrative, but not limiting, of the scope of the patent rights, which is set forth in the following claims.

What is claimed is:

1. A method comprising:

generating a first multi-source audio signal by panning each sound signal of a plurality of sound signals according to a first boundary of a sound scene and a respective virtual position of each sound source of a plurality of sound sources emitting each sound signal of the plurality of sound signals, the first boundary associated with a first audio channel of an audio system;

generating a second multi-source audio signal by panning each sound signal of the plurality of sound signals according to a second boundary of the sound scene and the respective virtual position, the second boundary associated with a second audio channel of the audio system;

spatializing, at the first audio channel, the first multi-source audio signal to the first boundary to generate a first left signal and a first right signal;

spatializing, at the second audio channel, the second multi-source audio signal to the second boundary to generate a second left signal and a second right signal; and generating a binaural signal for presentation to a user of the audio system using the first left signal, the second left signal, the first right signal, and the second right signal.

2. The method of claim 1, further comprising:

summing a first respective portion of each sound signal of the plurality of sound signals to generate the first multi-source audio signal; and summing a second respective portion of each sound signal of the plurality of sound signals to generate the second multi-source audio signal.

3. The method of claim 1, further comprising:

splitting, based on the respective virtual position, an energy of each sound signal of the plurality of sound signals between a first energy associated with the first boundary and a second energy associated with the second boundary to generate the first and second multi-source audio signals.

4. The method of claim 1, further comprising:

applying, to the first multi-source audio signal at the first audio channel, a first pair of head-related transfer functions (HRTFs) associated with the first boundary to generate the first left signal and the first right signal; and applying, to the second multi-source audio signal at the second audio channel, a second pair of HRTFs associated with the second boundary to generate the second left signal and the second right signal.

5. The method of claim 4, further comprising:

updating the first pair of HRTFs and the second pair of HRTFs based on a movement of a head of the user so that each sound source of the plurality of sound sources appears to originate from the respective virtual position that is fixed within the sound scene.

6. The method of claim 1, further comprising:

applying, at the first audio channel, a first plurality of spatial filters to the first multi-source audio signal to generate the first left signal and the first right signal; and applying, at the second audio channel, a second plurality of spatial filters to the second multi-source audio signal to generate the second left signal and the second right signal.

7. The method of claim 1, further comprising:

combining, at the first audio channel, the first left signal and the second left signal to generate a left component of the binaural signal for presentation to a left ear of the user; and combining, at the second audio channel, the first right signal and the second right signal to generate a right component of the binaural signal for presentation to a right ear of the user.

8. The method of claim 1, further comprising:

presenting the binaural signal to the user via a transducer array of the audio system.

9. The method of claim 1, wherein the plurality of sound sources are different people on a conference call with the user.

10. The method of claim 1, wherein the audio system is capable of being integrated into a headset worn by the user.

11. An audio system comprising:

a first audio channel;

a second audio channel; and an audio controller configured to:

generate a first multi-source audio signal by panning each sound signal of a plurality of sound signals according to a first boundary of a sound scene and a respective virtual position of each sound source of a plurality of sound sources emitting each sound signal of the plurality of sound signals, the first boundary associated with the first audio channel, generate a second multi-source audio signal by panning each sound signal of the plurality of sound signals according to a second boundary of the sound scene and the respective virtual position, the second boundary associated with the second audio channel, spatialize, at the first audio channel, the first multi-source audio signal to the first boundary to generate a first left signal and a first right signal, spatialize, at the second audio channel, the second multi-source audio signal to the second boundary to generate a second left signal and a second right signal, and generate a binaural signal for presentation to a user of the audio system using the first left signal, the second left signal, the first right signal, and the second right signal.

12. The audio system of claim 11, wherein the audio controller is further configured to:

sum a first respective portion of each sound signal of the plurality of sound signals to generate the first multi-source audio signal; and sum a second respective portion of each sound signal of the plurality of sound signals to generate the second multi-source audio signal.

13. The audio system of claim 11, wherein the audio controller is further configured to:

split, based on the respective virtual position, an energy of each sound signal of the plurality of sound signals between a first energy associated with the first boundary and a second energy associated with the second boundary to generate the first and second multi-source audio signals.

14. The audio system of claim 11, wherein the audio controller is further configured to:

apply, to the first multi-source audio signal at the first audio channel, a first pair of head-related transfer functions (HRTFs) associated with the first boundary to generate the first left signal and the first right signal; and apply, to the second multi-source audio signal at the second audio channel, a second pair of HRTFs associated with the second boundary to generate the second left signal and the second right signal.

15. The audio system of claim 11, wherein the audio controller is further configured to:

apply, at the first audio channel, a first plurality of spatial filters to the first multi-source audio signal to generate the first left signal and the first right signal; and apply, at the second audio channel, a second plurality of spatial filters to the second multi-source audio signal to generate the second left signal and the second right signal.

16. The audio system of claim 15, wherein the audio controller is further configured to:

update the first plurality of spatial filters and the second plurality of spatial filters based on a movement of a head of the user so that each sound source of the plurality of sound sources appears to originate from the respective virtual position that is fixed within the sound scene.

17. The audio system of claim 11, wherein the audio controller is further configured to:

combine, at the first audio channel, the first left signal and the second left signal to generate a left component of the binaural signal for presentation to a left ear of the user; and combine, at the second audio channel, the first right signal and the second right signal to generate a right component of the binaural signal for presentation to a right ear of the user.

18. The audio system of claim 11, further comprising a transducer array coupled to the audio controller, the transducer array configured to present the generated binaural signal to the user.

19. The audio system of claim 11, wherein the audio system is integrated into a headset worn by the user, or the audio system is distributed between a computing device separate from the headset and the headset interfaced with the computing device via a wired connection or a wireless connection.

20. A non-transitory computer-readable storage medium of an audio system, the non-transitory computer-readable storage medium having instructions encoded thereon that, when executed by a processor of the audio system, cause the processor to:

generate a first multi-source audio signal by panning each sound signal of a plurality of sound signals according to a first boundary of a sound scene and a respective virtual position of each sound source of a plurality of sound sources emitting each sound signal of the plurality of sound signals, the first boundary associated with a first audio channel of the audio system;

generate a second multi-source audio signal by panning each sound signal of the plurality of sound signals according to a second boundary of the sound scene and the respective virtual position, the second boundary associated with a second audio channel of the audio system;

spatialize, at the first audio channel, the first multi-source audio signal to the first boundary to generate a first left signal and a first right signal;

spatialize, at the second audio channel, the second multi-source audio signal to the second boundary to generate a second left signal and a second right signal; and generate a binaural signal for presentation to a user of the audio system using the first left signal, the second left signal, the first right signal, and the second right signal.

* * * * *